US009066596B2

(12) United States Patent
Clark et al.

(10) Patent No.: US 9,066,596 B2
(45) Date of Patent: Jun. 30, 2015

(54) SEATING ASSEMBLY

(71) Applicants: Jeffrey L. Clark, Commerce Township, MI (US); Richard N. Clark, Farmington Hills, MI (US)

(72) Inventors: Jeffrey L. Clark, Commerce Township, MI (US); Richard N. Clark, Farmington Hills, MI (US)

( * ) Notice: Subject to any disclaimer, the term of this patent is extended or adjusted under 35 U.S.C. 154(b) by 48 days.

(21) Appl. No.: 13/694,269

(22) Filed: Nov. 14, 2012

(65) Prior Publication Data

US 2014/0132050 A1 May 15, 2014

(51) Int. Cl.
*A47C 3/18* (2006.01)
*B63B 29/04* (2006.01)

(52) U.S. Cl.
CPC .. *A47C 3/18* (2013.01); *B63B 29/04* (2013.01)

(58) Field of Classification Search
USPC ..... 297/411.32, 411.35, 411.38, 344.21, 297/344.22
See application file for complete search history.

(56) References Cited

U.S. PATENT DOCUMENTS

| | | | | | |
|---|---|---|---|---|---|
| 2,858,876 | A * | 11/1958 | Woodson, Jr. | ..... | 297/353 |
| 4,544,202 | A * | 10/1985 | Keaton | ..... | 297/344.22 |
| 4,648,656 | A * | 3/1987 | Kimura | ..... | 297/337 |
| 4,709,961 | A * | 12/1987 | Hill | ..... | 297/284.11 |
| 4,913,564 | A * | 4/1990 | Stephan et al. | ..... | 384/518 |
| 5,183,312 | A * | 2/1993 | Nania | ..... | 297/256.12 |
| 5,702,157 | A * | 12/1997 | Hurite | ..... | 297/411.38 |
| 5,992,935 | A * | 11/1999 | Duijnstee | ..... | 297/344.21 |
| 6,056,359 | A * | 5/2000 | Clark | ..... | 297/237 |
| 6,499,712 | B1 * | 12/2002 | Clark et al. | ..... | 248/429 |
| 6,536,842 | B2 * | 3/2003 | Bowers et al. | ..... | 297/344.22 |
| 6,591,541 | B1 * | 7/2003 | Cummings | ..... | 43/21.2 |
| 6,736,084 | B2 * | 5/2004 | McDonough et al. | ..... | 114/363 |
| 7,000,874 | B2 * | 2/2006 | Schuler et al. | ..... | 248/157 |
| 7,073,859 | B1 * | 7/2006 | Wilson | ..... | 297/256.1 |
| 7,357,451 | B2 * | 4/2008 | Bendure et al. | ..... | 297/256.12 |
| D580,685 | S * | 11/2008 | Draghici et al. | ..... | D6/495 |
| 7,938,372 | B2 * | 5/2011 | MacLeod | ..... | 248/122.1 |
| 8,210,613 | B2 * | 7/2012 | Adelsperger et al. | .... | 297/344.22 |
| 8,292,368 | B1 * | 10/2012 | Yarbrough | ..... | 297/344.12 |
| 8,517,466 | B1 * | 8/2013 | Wizorek et al. | ..... | 297/232 |
| 8,585,146 | B1 * | 11/2013 | Giasson et al. | ..... | 297/344.1 |
| 2006/0082211 | A1 * | 4/2006 | Slabaugh et al. | ..... | 297/452.56 |
| 2008/0251001 | A1 * | 10/2008 | Draghici et al. | ..... | 114/363 |
| 2009/0039692 | A1 * | 2/2009 | Tuckey et al. | ..... | 297/344.22 |

* cited by examiner

*Primary Examiner* — Sarah B McPartlin
(74) *Attorney, Agent, or Firm* — John G. Chupa

(57) ABSTRACT

A seating assembly 10 having a pair of armrests 12, 14; a footrest 20; a backrest 30, and a seat portion 24 which may each be independently and selectively moveable.

4 Claims, 8 Drawing Sheets

SEATING ASSEMBLY

FIELD OF THE INVENTION

The present invention generally relates to a seating assembly and more particularly to a seating assembly which may be selectively and axially movable, which has a pair of substantially identical arms which are each selectively movable from a first respective extended position to a second respective raised position, and which has a selectively rotatable seat portion, and which further includes a selectively foldable footrest.

BACKGROUND OF THE INVENTION

A seating assembly is operatively deployed within a wide variety of environments in which it is necessary or desirable to allow individuals to occupy a seated position. For example, within a watercraft, such as a boat, it is desirable to allow an individual to occupy a seated position while operating the boat and it is further desirable to allow the watercraft passengers to respectively occupy seated positions while they are within the confines of the watercraft.

Importantly, in order to provide an overall comfortable seating experience, it is highly desirable to allow the providing seating assemblies to be selectively adjustable and such selective adjustability is also desired to facility collaboration and desired activities of the occupants within the seating environment. Moreover, such desired adjustability should be provided in an efficient and cost effective manner.

Current seating assemblies do not adequately provide a full range of desired adjustability and do not provide desired adjustability in a cost effective manner.

SUMMARY OF THE INVENTION

It is a first non-limiting object of the present invention to provide a seating assembly which overcomes all of the previously delineated drawbacks of prior seating assemblies.

It is a second non-limiting object of the present invention to provide a seating assembly which overcomes all of the previously delineated drawbacks of prior seating assemblies and which, by way of example and without limitation, has a pair of independently and selectively movable arms.

It is a third non-limiting object of the present invention to provide a seating assembly which overcomes all of the previously delineated drawbacks of prior seating assemblies and which, by way of example and without limitation, has a seating portion which is selectively rotatable.

It is a fourth non-limiting object of the present invention to provide a seating assembly which overcomes all of the previously delineated drawbacks of prior seating assemblies and which, by way of example and without limitation, has a seating portion which is selectively and axially moveable.

It is a fifth non-limiting object of the present invention to provide a seating assembly which efficiently and cost effectively provides desired adjustability and articulation and which includes, by way of example and without limitation, a selectively foldable footrest and which may be selectively locked into a desired position.

According to a first non-limiting aspect of the present invention, a seating assembly having two independently and selectively movable arms is provided.

According to a second non-limiting aspect of the present invention, seating assembly having a pair of substantially identical, independently, and selectively movable arms and further having a selectively rotatable seat is provided.

According to a third non-limiting aspect of the present invention, a seating assembly a seating assembly having a seat which is selectively and axially movable is provided.

According to a fourth non-limiting aspect of the present invention, a seating assembly having a seat including a footrest which is selectively foldable from a first closed position to a second open position, is provided.

According to a fifth non-limiting aspect of the present invention, a seating assembly is provided with a selectively reclinable seat back and which further may be selectively locked into place.

According to a sixth non-limiting aspect of the present invention, a seating assembly is provided which includes a concealed movement mechanism which allows for the selective movement and locking of both the arm rests and the seat back portion.

According to a seventh non-limiting aspect of the invention, a seating assembly is provided which includes multi-tooth locking mechanism for movement of the seat portion and multi-tooth locking mechanism for each of the arm rests.

According to an eighth non-limiting aspect of the present invention, a seating assembly is provided and which includes a selectively moveable booster and a selectively moveable footrest.

According to a ninth non-limiting aspect of the present invention, a seating assembly is provided which may be selectively configured in a plurality of separate functionalities to achieve a plurality of objectives.

These and other features, aspects, objects, and advantages of the present inventions will become apparent from a reading of the following detailed description of the preferred embodiment of the invention, including the sub-joined claims, and from a review of the following drawings.

DETAILED DESCRIPTION OF THE PREFERRED EMBODIMENT OF THE INVENTION

Figure 1:
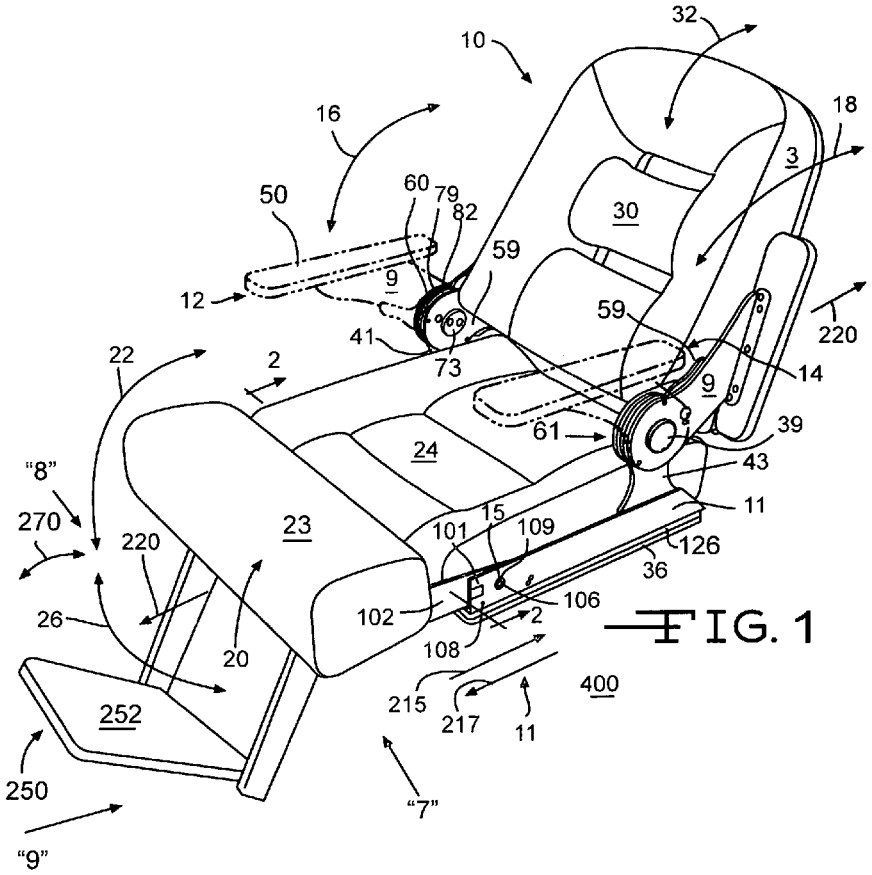
FIG. 1 is a perspective view of a seating assembly which is made in accordance with the teachings of the preferred embodiment of the invention.

Referring initially now to FIGS. 1-9, there is shown a seating assembly 10 which is made in accordance with the teachings of the most preferred embodiment of the various inventions.

Particularly, seating assembly 10 includes a pair of substantially identical and opposed arms or arm rests 12, 14 which are each respectively, independently, and selectively movable along respective arcs 16, 18; a selectively movable bolster portion 20 which is selectively and independently moveable along arc 22; a seat portion 24 which is independently and selectively rotatable along arc 26; and a back portion 30 which is selectively and independently and axially movable (i.e., selectively reclinable) along arc 32. The seat portion 24 is further selectively and independently moveable in the directions 215, 217. The selective and independent movement of portions 12, 14, 20, 24, and 30 allows an occupant of the seating assembly 10 to be comfortable and to be able to selectively articulate within an overall environment (such as within a boat or watercraft) to a desired location and in a desired position.

In this regard, the base plate 126, of the seating assembly 10 (which is perhaps best shown in FIG. 2-5) is bolted or otherwise secured to the floor or other portion (such as a pedestal) 400 of an interior of a boat or to the floor or other portion of the environment in which the seating assembly 10 is operatively deployed. Further, it should be appreciated the term "independent", as used in this description and referring to a portion 12, 14, 20, 24, 30 means that these portions respectively and selectively move independently of the other portions 12, 14, 20, 24, and 30. Such independent movement allows the seating assembly 10 to be selectively articulated in a wide variety of desired positions.

A more detailed description of the two substantially identical arms or armrests 12, 14 will now ensue. That is, each arm rest 12, 14 has a respective wide and flat top portion 50 which is adapted to support an arm and/or beverage and/or various other items which may be utilized by an occupant of the seating assembly 10. Each top portion 50 is coupled to a respective angular support member 9. Further, as is best perhaps shown in FIGS. 1, 5, 6, arm rest 12 (the following discussion is equally applicable to arm rest 14 since arm rest 12 and arm rest 14 are substantially identical), includes a base portion 41 (which is substantially similar to base portion 43 of the arm rest 14). Arm rest 12 is movably coupled to base portion 41 by a gear mechanism 200. Similarly, arm rest 14 is movably coupled to base portion 43 by a substantially similar gear mechanism 61 to that of mechanism 200. The base portion 41 is coupled to the seat portion 24 by rail 3 (which is substantially similar to rail 11 which couples base portion 43 to the seat portion 24) rails 3 and 11 may be configured as desired and each of the rails 3, 11 are respectively coupled to the base plate 126 and rail 3 coupled portion 41 to plate 126 while rail 11 couples portion 43 to plate 126.

Through the upper portion of the base portion 41, which is distal from the rail 3, is disposed an axle member 73 upon which is in a parallel or horizontal relationship to rail 3 and upon which is operatively disposed a first gear 60 having a plurality of substantially identical teeth 64 and a pawl 66 which is coupled to spring assembly 68 which normally biases the surface 69 of the pawl 66 against the teeth 64, thereby fixing the armrest 12 in the operative position which is shown in FIG. 1 with the flat base portion 50 deployed generally parallel to the seat portion 24. The spring assembly 68 moveably couples the pawl 66 to the support member 9 and to the gear 60. The gear 60 is circular and has a center opening 7 which frictionally receives the axle 73, thereby fixing the gear 60 upon the axle 73. Particularly, the spring assembly 68 couples the pawl 66 to the support member 9 just above the gear teeth 64 and distal from the base 41. The gear mechanism or ratchet assembly 200 includes the axle 73, spring 68, teeth 64, and the pawl 66.

To selectively move the arm rest 12, along a clockwise direction along the arc of movement 16, the lever portion 71 of the pawl 66 is lifted in the direction 75, thereby forcibly disengaging the surface 69 from engagement with the plurality of teeth 64, thereby allowing the support member 9 of the arm rest 12 to be moved along a clockwise direction along the arc 16. When the lever portion 71 is released, the spring assembly 68 automatically (without the need for further user intervention or action) moves the surface 69 in an engagement relationship with the plurality of teeth 64 and thus automatically fixes the position of support member 9 of the arm rest 12 in whatever position the arm rest 12 was most recently moved to when the lever 71 was released. The gear 60, axle 73, lever 71, pawl 66, and spring member 68 cooperatively form a first ratchet assembly or gear mechanism 200. In this manner, the arm rest 12 is normally and automatically placed in a fixed position. It should be realized that the gear assembly 200 does not prevent the movement of the arm rest 12 in the counter clockwise direction along the movement arc 16 because the gear 60 does not prevent such movement.

Arm rest 14 is similarly and selectively moved in substantially the same manner as explained above with respect to arm rest 12 but by use of a separate and second gear or ratchet assembly 61 which is substantially similar to this previously explained first ratchet assembly and an axle member 39 which is substantially similar to axle member 73. In this manner, each arm rest 12, 14 are independently and selectively movable with respect to the remainder of the seating assembly 10.

Further, a generally circular bearing 79 is deployed upon the axle member 73 between the first gear 60 and a gear 82 which operatively forms a part of a third ratchet assembly 80 and the bearing 79 reduces friction between the selectively and independently moveable gears 60, 82 and may be made from a polymer type of material.

Particularly, this third ratchet assembly 80 includes this gear 82 having a plurality of substantially identical teeth 84, a spring assembly 88, and a pawl 86. The gear 82 frictionally receives and resides upon the axle member 73 which traverses both gear members 82 and 60. The pawl 86 is coupled to the seat back flange portion 59 by the spring assembly 88 which normally biases the surface 94 of the pawl 86 against the plurality of teeth 84, thereby fixing the seat back portion 30 in a desired position. When it is desired to selectively move the seat 30 to a different position, along a counter-clockwise direction 210 of arc 32, then the lever portion 98 of the pawl 86 is moved in the direction 99, thereby selectively allowing the back portion 30 to be selectively and independently moved in a counter-clockwise direction, along directional arc 32 because teeth 84 are disengaged from surface 94. In an alternate and non-limiting embodiment of the invention, the third ratchet assembly 80 may alternatively and operatively be operatively coupled to the portion of the seat back portion 30 which is closest to the base member 3; that is, the side 3 of seat back portion 30. It should be appreciated that seat back portion 30 may be moved along the clockwise direction of arc 32 without disengaging the pawl 86 from the teeth 84. Alternatively, other gear mechanisms could be used in combination with the arm rests 12, 14 and seat back portion 30 which allow for restricted movement in both the clockwise and counter clockwise direction and with restricted movement in any single desired direction. It should be appreciated that the use of "multi-teeth" gears to facilitate selective movement of the arm rests 12, 14 and seat back portion allow for fine incremental movement and stronger position and an overly secure locking mechanism to comply with American Boat And Yacht Council (ABYC) Safety Standards. The use of a lot of small teeth allows for small incremental movement. A fourth ratchet assembly, which is substantially identical to this afore described third ratchet assembly 80 may be deployed upon axle 39.

Each of the three ratchet assemblies used to respectively facilitate the selective movement of the arm rests 12, 14 and seat back portion 30 have gears, panels and springs which are concealed from view and are therefore "pocketed" or "covered". That is, (in one non-limiting embodiment, ratchet assemblies 200, 80 are operatively placed between a unique pair of portions 9 and 59) and the ratchet assembly 61 (and the fourth ratchet assembly (if utilized)) is similarly hidden between unique pairs of portions 9 and 59, thereby allowing for an overall aesthetically pleasing appearance; protection from environmental damage or degradation (e.g., sea salt); and a safer assembly because these components do not touch the operator and occupants.

Figure 7:
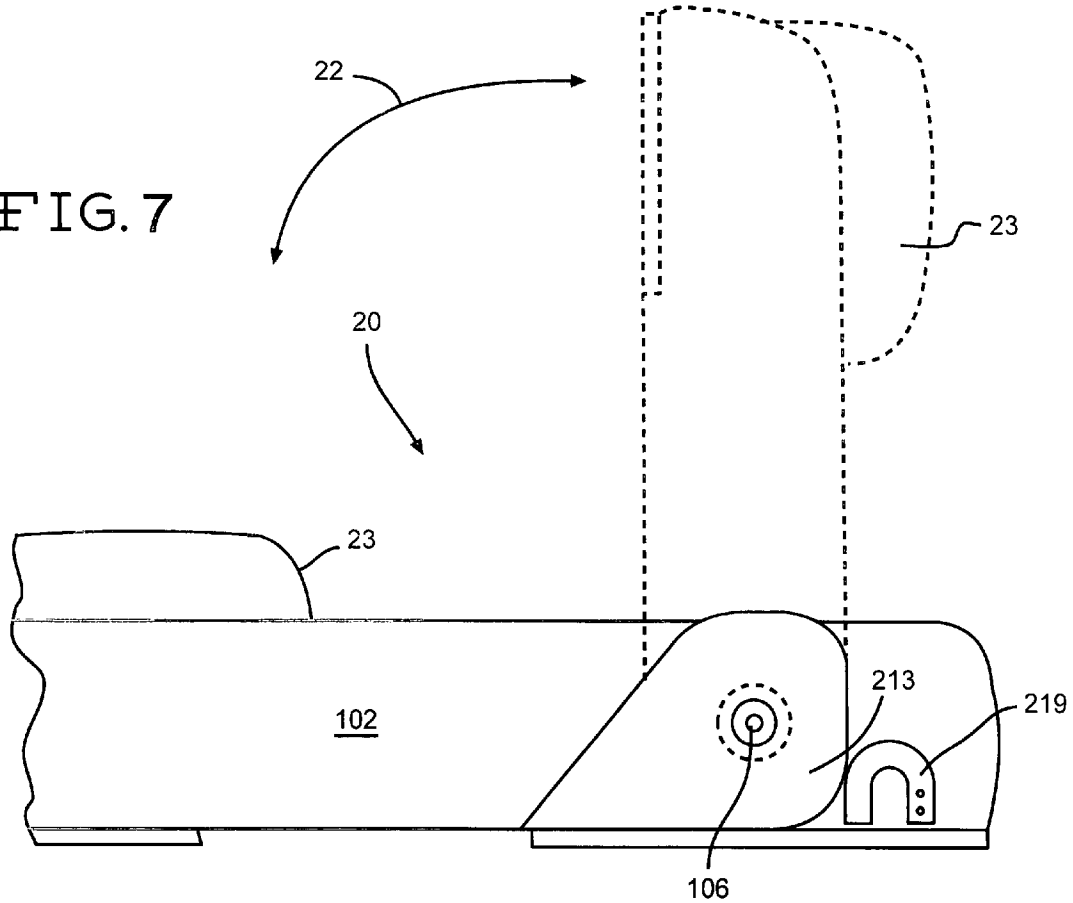
FIG. 7 is a partial view of the seating assembly which is shown in FIG. 1 and taken in the direction of view arrow "7".

With respect to the selective movement of the bolster 20, reference is now made to FIGS. 1 and 7. As shown, the bolster portion 20 has a support portion 23 which is coupled to at least one arm 102, and the arm 102 which is coupled to the member 11 by a removable pin 106, thereby allowing the bolster 20 to selectively move along the directional arc 22, and such movement is independent of the movement of portions 12, 14, 24, and 30.

The bolster 20 when fully moved in the clockwise direction along movement arc 22 will have a portion 213 which will selectively engage and be frictionally received by a latch spring 219 which will frictionally hold portion 213 thereby holding the bolster 20 in an upright position that allows the holster 20 to be easily dislodged and later selectively moved counterclockwise along arc 22.

Figure 8:
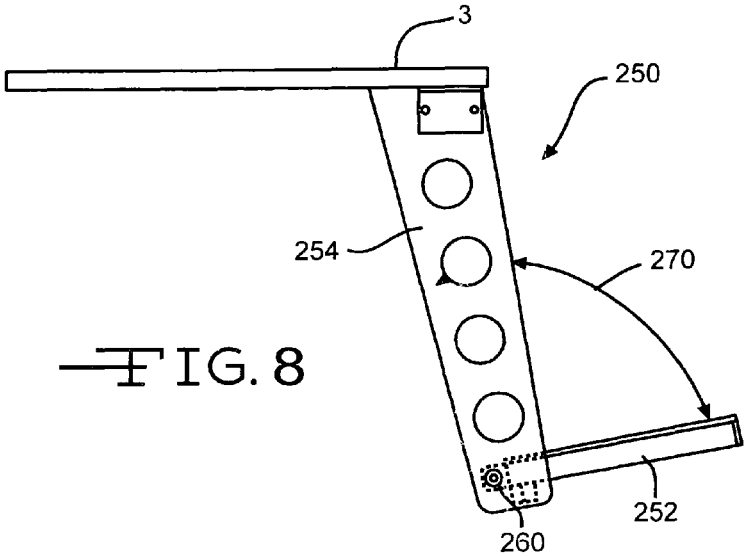
FIG. 8 is a partial side view of the seating assembly shown in FIG. 1 taken in the direction of view arrow "8".
Figure 9:
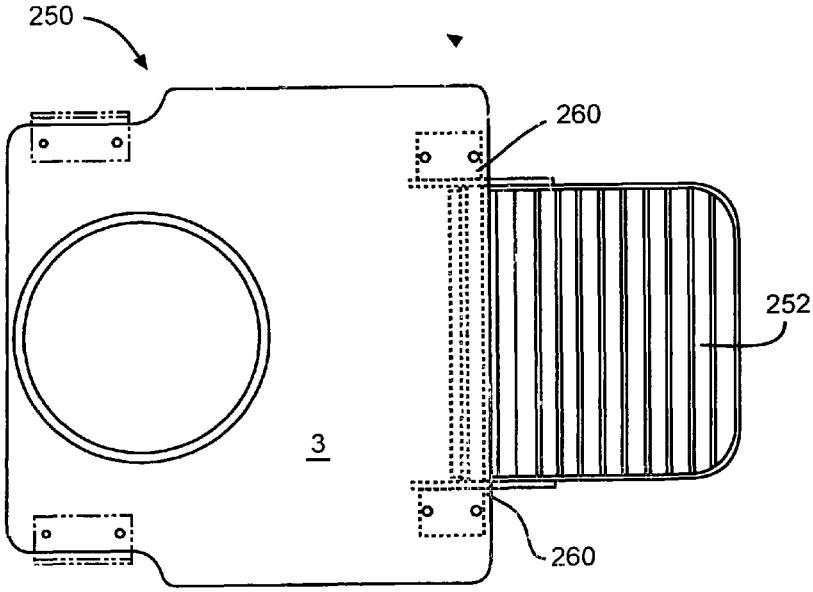
FIG. 9 is a view of the portion of the seating assembly which is shown in FIG. 8 and taken in the direction of view "9"

Referring now to FIG. 1, 8, 9, there is shown a footrest portion 250 which includes a foot engagement portion 252 and a bracket 254 which is coupled to rails 3, 11. The portion 252 is pivotally coupled to each opposed side of the brackets 254 by a respective pin 260 thereby allowing for desired movement of the portion 250 along arch 270. When the portion 252 is selectively expanded, as shown in FIGS. 1 and 8, the feet of the user (the one seated in seat assembly 10) may be supported by the portion 252.

Figure 2:
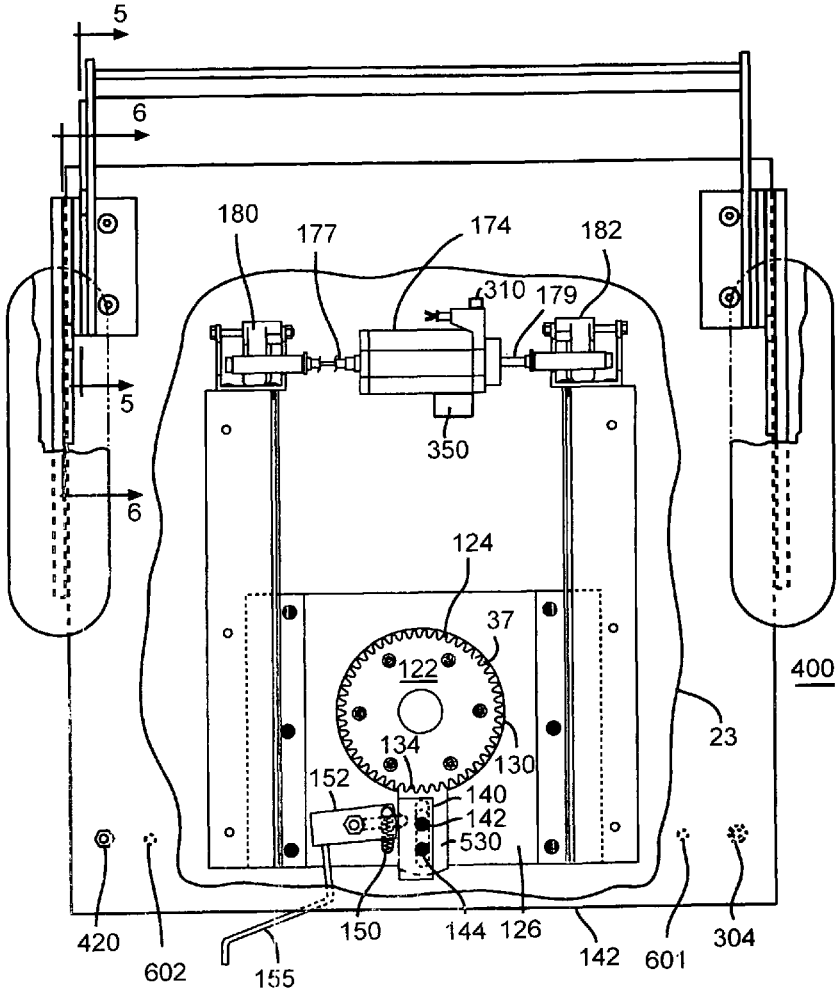
FIG. 2 is top "cut-away" view of the seating portion of the seating assembly which is shown in FIG. 1 and which is taken along view line "2-2".
Figure 3:
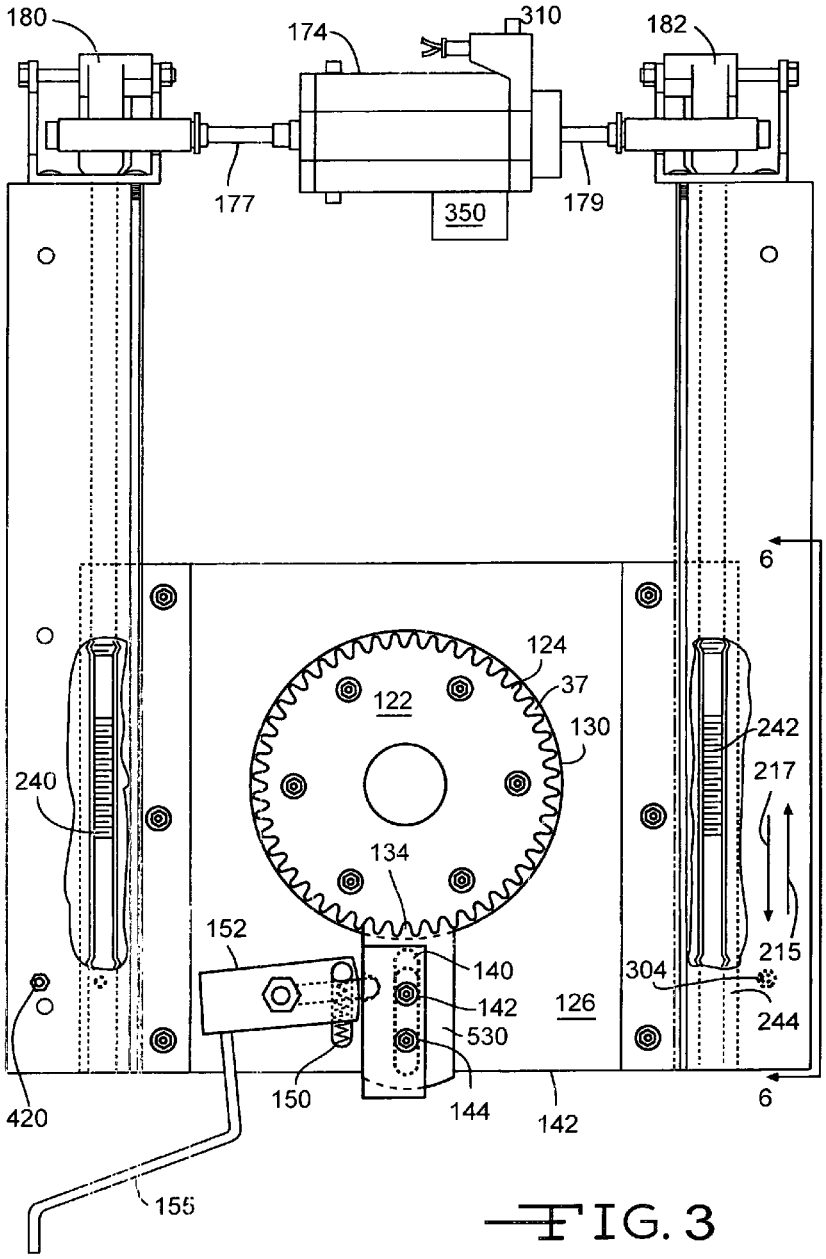
FIG. 3 is a partially expanded view of a portion of the seating assembly which is shown in FIG. 2 and which is shown in view area "23".
Figure 4:
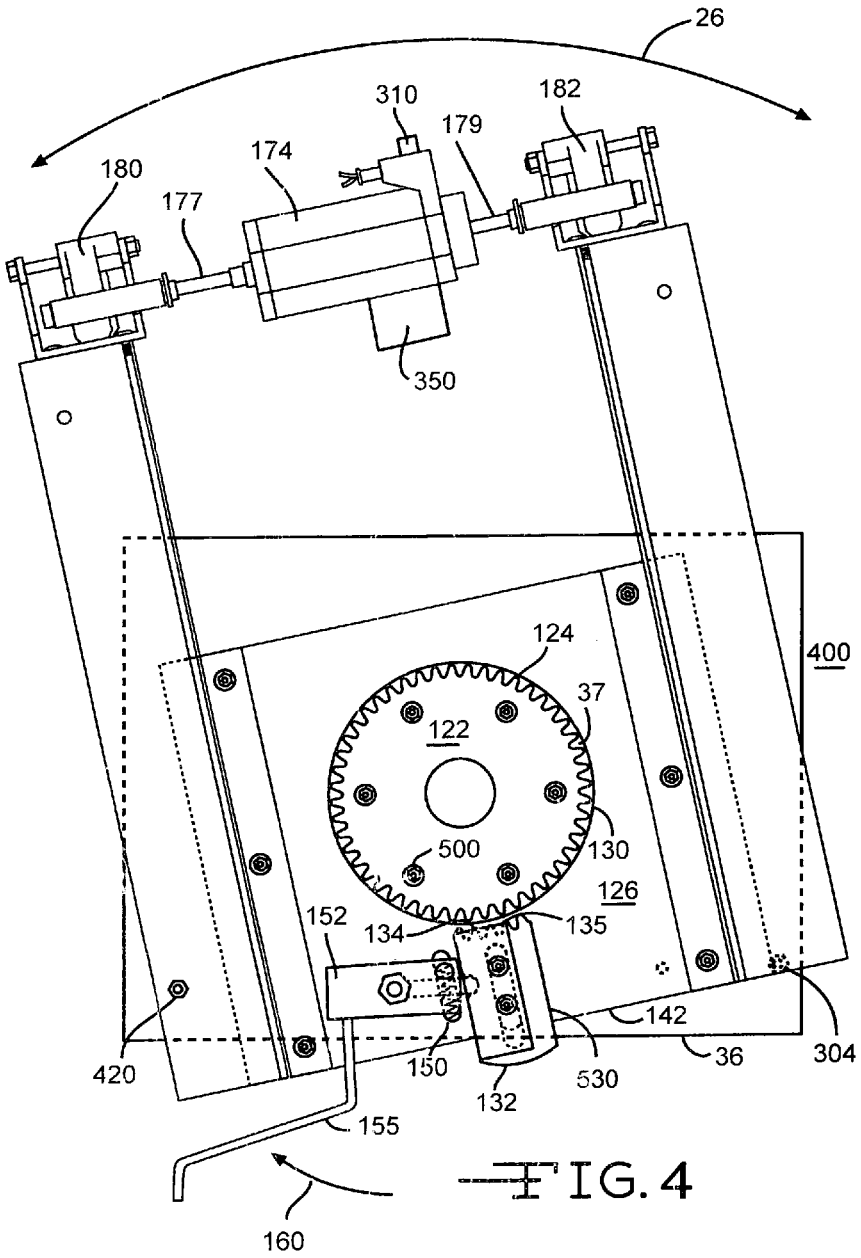
FIG. 4 is a view which is similar to that which is shown in FIG. 3 but which is selectively rotated in accordance with the teachings of the preferred embodiment of the invention.
Figure 5:
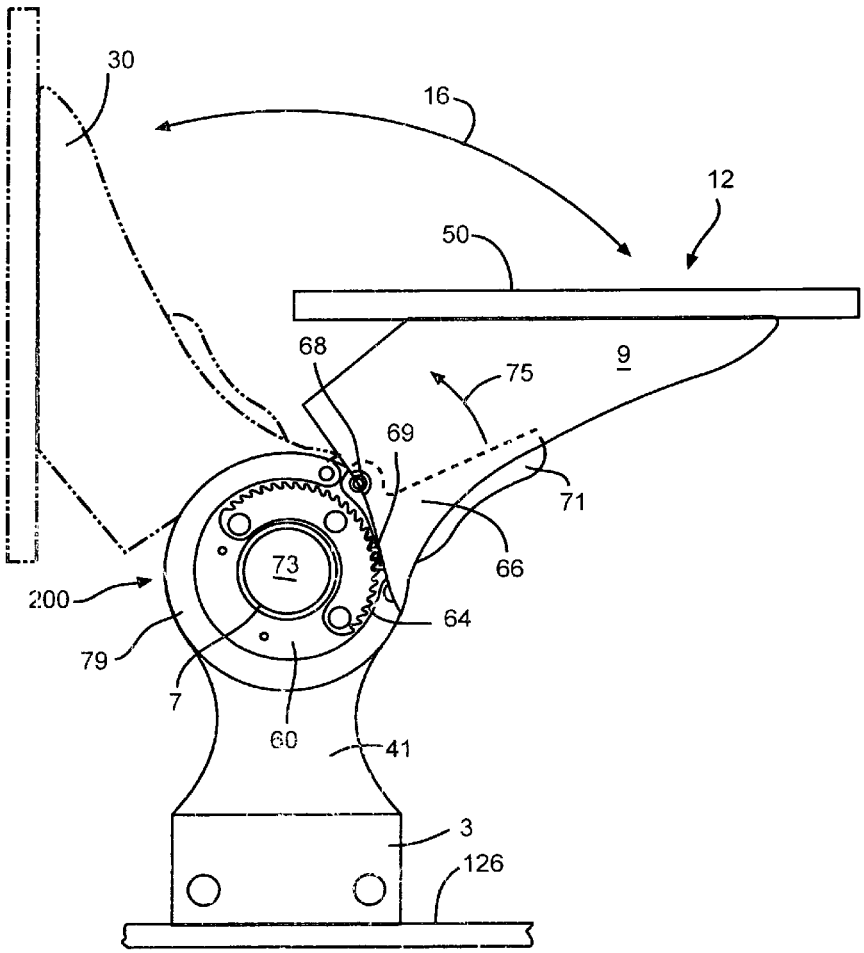
FIG. 5 is a side sectional view of the portion of the seating assembly which is shown in FIG. 2 and which is taken along view line "5-5" and which shows selective movement of this portion in a first direction.
Figure 6:
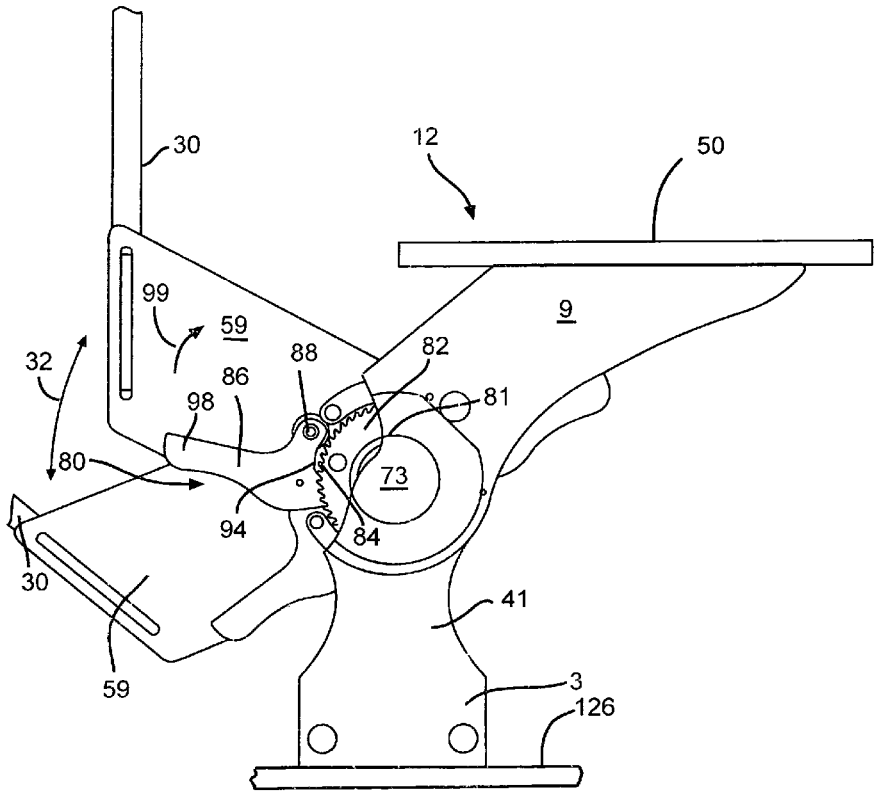
FIG. 6 is a side sectional view of the portion of the seating assembly which is shown in FIG. 2 and which is taken along view 6-6 and which shows selective movement of this portion in a second direction

Referring now to FIGS. 2-4, it should be appreciated that in the most preferred (although non-limiting) embodiment of the invention, the seating portion 24 includes a generally flat and lower frame member 36 (which is normally bolted to a floor 400) and which has a generally circular opening 37 within which a generally circular gear 122, having a plurality of substantially identical perimeter positioned teeth 124 is deployed. In one non-limiting embodiment, the flat body of the gear is bolted to the plate 36 by bolts 500. Other security techniques may be utilized. Rail members 3 and 11 may be welded, bolted, or otherwise secured to plate 126.

The seating assembly 10 further includes an upper frame member 126 which has a generally circular opening 130 which frictionally receives the gear 122 and which movably resides upon the lower frame member 36 and which is adapted to selectively rotate with respect to the lower frame member 36.

In one non-limiting embodiment of the invention, the frame members 36 and 126 are coupled by the gear 122 which is seated within each of the members 36, 126. Other coupling strategies may be employed.

Movably deployed upon the upper frame member 126 is a pawl or gear locking member 530 having a lever portion 132 and a tooth engaging portion 134 which is complementary to the shape and size of the plurality of teeth 124. That is, portion 134 has a plurality of indentations 135 which are each adapted to receive and engage a selected and single one of the plurality of teeth 124.

In one non-limiting embodiment of the invention, a channel 140 is formed in the gear locking member 530 and upon the under surface 142 of the member 126 (e.g., upon the surface of the member 126 which is proximate to the lower frame member 36) are deployed a pair of substantially identical pins 142, 144 which are coupled to the lower frame 36. These pins 142, 144 extend into the formed channel 140 and constrain the movement of the member 530 in the directions 215, 217. The pins 142, 144 cooperatively allow the member 530 to selectively and reciprocally move along within the channel 140 in a manner which will now be described.

That is, when the member 530 is moved forward (toward the back portion 30 and in direction 215) then the portion 134 engages a selected plurality of teeth 124 and fixes the seating portion 24 at a certain location. When the member 530 is moved away from the gear 122 (in direction 217), then the seat portion 24 may be selectively rotated along movement arc 26, independently of any movement of any of the other portions 12, 14, 20, and 30. This movement occurs because portion 126 is allowed to selectively rotate with respect to plate 36. That is, such selective rotation occurs by forced movement of the top frame member 126 around the gear 122 and thus the top frame member 126 is allowed to selectively rotate with respect to the bottom frame member 36, thereby causing the seat portion 24 (and the assembly 10) to selectively rotate since the portion 24 is coupled to the frame member 126.

When the seat portion 24 is moved to a desired location, then the member 530 is returned to its normal position in which a selective plurality of teeth 124 are engaged by portion 134. In the most preferred, although non-limiting embodiment of the invention, the member 530 is normally biased against the gear 122 by use of the spring member 150 which is coupled to a member 152. The member 152 is coupled to a handle 155 which extends from the seat portion 24 and when the handle portion 155 is stationary, the spring 150 causes force to be applied by the member 152 against the member 530, effective to move the portion 134 of the member 530 against the teeth 124 of the gear 122 and thereby fixing the position of the top frame member 126 with respect to the bottom frame member 36 and fixing the position of the seating portion 24 When it is desired to selectively rotate the seating portion 24, the handle member 155 is moved in the direction 160, thereby forcibly counteracting the normal biasing force of the spring 150 and causing the portion 134 to become disengaged from the teeth 124.

As is shown best in FIGS. 2-4, the seating assembly 10 may be axially moved in directions 215, 217 by the use of motor 174, gear boxes 180, 182, and arm assemblies 177, 179 which are respectively coupled to gear boxes 180, 182, and to the portion 24. A power supply, such as a battery 350, is coupled to the motor 174 and provides electrical energy to allow the motor 174 to operate, and a switch 310 is also coupled to the motor 174. Threaded rods 240, 242 are respectively coupled to gearboxes 180, 182 and to platform 126. The axial movement is described within U.S. Pat. No. 6,499,712, owned by the Assignee of the present Application and which is fully and completely incorporated herein by reference.

Thus, when it is desired to move the seating assembly 10 in the axial direction 215, the switch 310, which is coupled to the motor 174, is moved to a first direction, effective to cause the motor 174 to rotate in a first direction which causes the threaded rods 240, 242 to rotate in a clockwise direction and thereby move the seat assembly 10 toward direction 217. When the switch 310 is moved to a second direction, the motor 174 rotates in a second direction which is counterclockwise and this causes the threaded rods 240, 242 to rotate in a counterclockwise direction, effective to move the seating assembly 10 towards direction 215. In this manner, the seating assembly 10 selectively moves in directions 215, 217.

In one non-limiting embodiment, a detent 420 is deployed upon the plate 126 and a detent 304 is deployed upon plate 36 and openings 602, 601, are respectively formed upon plates 126, 36. The detent 420 enters opening 601, and the detent 504 enters opening 602 engage if the plate 126 rotates beyond a certain amount, thereby preventing undesired rotational movement. Alternatively, the openings may be obviated and the detents 420, 304 may be adapted to engage to prevent undesired rotation.

In a second non-limiting embodiment, the seating assembly 10 may be dynamically configured and built to order. Example, in one non-limiting configuration only one arm rest 12 may be provided and in another non-limiting embodiment there may be no rotation of the seat portion 24 and no need for plate 126 or gear 122. Thus, each of the afore described functional entities may be placed into a final seat assembly or left out at the design of the user and the seating assembly 10 is thereafter modular. Moreover, by using a relatively large number of teeth on each of the afore described gears, fine incremental movement may be achieved with respect to each of the arm rests 12, 14, seating portion 24; and portion 30.

It is to be understood that the present inventions are not limited to the specific embodiments which have been disclosed above, but that various changes and modifications may be made to them without departing from the spirit and the scope of the claims as they are set forth in the following claims.

What is claimed is:

1. A seating assembly comprising a first plate having a first circular opening; a second plate having a second circular opening, wherein said second plate movably and rotatably resides upon a surface of said first plate and wherein said first and second circular openings are aligned; a circular gear having a plurality of substantially identical perimeter positioned teeth, which is coupled to the first plate, and which is seated within said aligned openings, wherein said seating assembly further includes a gear locking assembly which is movably disposed upon said second plate and which includes a body having a tooth engaging portion which includes a plurality of indentations which are each complementary to the size and shape of each of said gear teeth and wherein said body is movable from a first position in which said tooth engaging portion is remote from said circular gear, thereby allowing said second plate to selectively rotate upon said first plate, to a second position in which at least one of said gear teeth reside in an indentation of said gear locking member, thereby preventing rotation of said second member upon said first member, and wherein said body of said gear locking assembly including a first longitudinal channel and wherein a second longitudinal channel is formed in said second member and is aligned with said first longitudinal channel and wherein said gear locking assembly further includes a plurality of pins which are coupled to said first plate and which reside within each of aligned channels and into said body, whereby said pins movably fix said body of said gear locking assembly upon said second plate; a handle assembly biased by a biasing spring, said handle assembly resides upon and extends from said second plate and selectively moves said body of said gear locking assembly, thereby allowing said tooth engaging portion to be moved to a position remote from said circular gear, thereby allowing said second plate to selectively rotate with respect to said first plate, and wherein said seating assembly comprises a seat which is coupled to said first and second plates.

2. The seating assembly of claim 1 further comprising a bolster which is coupled to said seat.

3. The seating assembly of claim 2 further comprising a motor assembly which is coupled to said second plate.

4. The seating assembly of claim 3 further comprising a pair of armrests which are coupled to said seat; and at least one gear which allows one of said pair of armrests to selectively occupy one of a plurality of selectable position.

* * * * *